US005959506A

United States Patent [19]

Aves

[11] Patent Number: 5,959,506

[45] Date of Patent: Sep. 28, 1999

[54] COAXIAL WAVEGUIDE CORNER

[76] Inventor: Donald Aves, 96 Sweetmans La., Englishtown, N.J. 07726

[21] Appl. No.: 09/073,204

[22] Filed: May 4, 1998

[51] Int. Cl.[6] ..... H01P 1/02

[52] U.S. Cl. ..... 333/33; 333/245; 333/260

[58] Field of Search ..... 333/33, 243–245, 333/249, 260; 439/582

[56] References Cited

U.S. PATENT DOCUMENTS 2,813,144 11/1957 Valach ..... 333/260 X
4,564,826 1/1986 Wiesenfarth et al. ..... 333/249

FOREIGN PATENT DOCUMENTS 263635 1/1989 Germany ..... 333/245

*Primary Examiner*—Paul Gensler
*Attorney, Agent, or Firm*—Milde, Hoffberg & Macklin, LLP

[57] ABSTRACT

A coaxial waveguide corner structure, having a pair of incoming inner conductors, each inner conductor having an axis and an end, the pair of inner conductors having non-coincident axes, and a conductive bridging element having two ends within an enclosure. Each end of the conductive bridging element is adapted to provide a continuous conductive surface between the outer edge of the pair of inner conductors, adapted to provide a low loss and low reflection radio frequency electromagnetic wave path between said pair of inner conductors. The conductive bridging element thus has a section profile matching a section profile of the adjoining inner conductor, at the respective bevel angles. The conductive bridging element preferably has a cross section shape different than a cross section shape of the conductors, preferably elliptical.

21 Claims, 3 Drawing Sheets

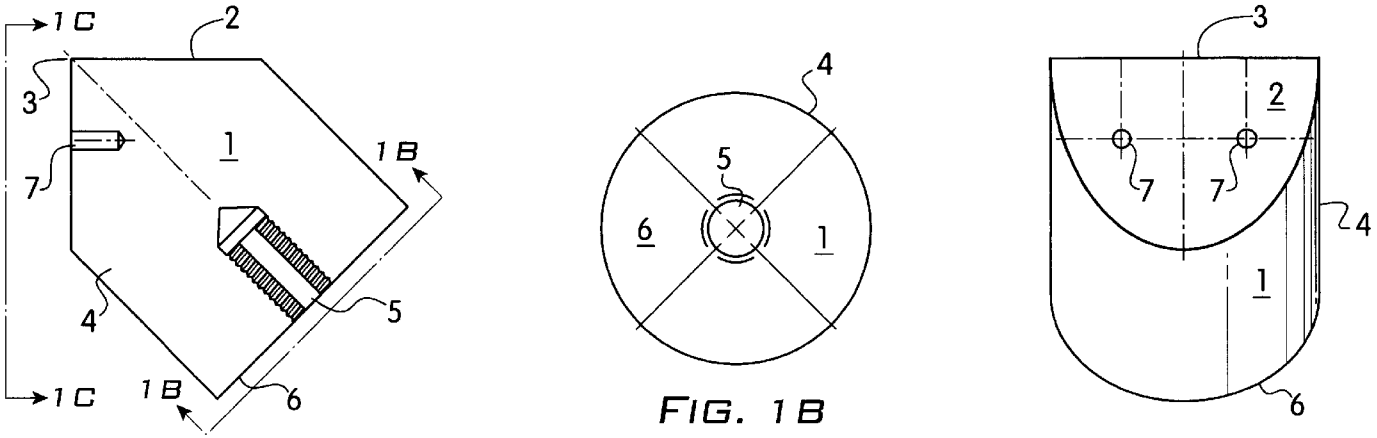
FIG. 1A
FIG. 1B
FIG. 1C
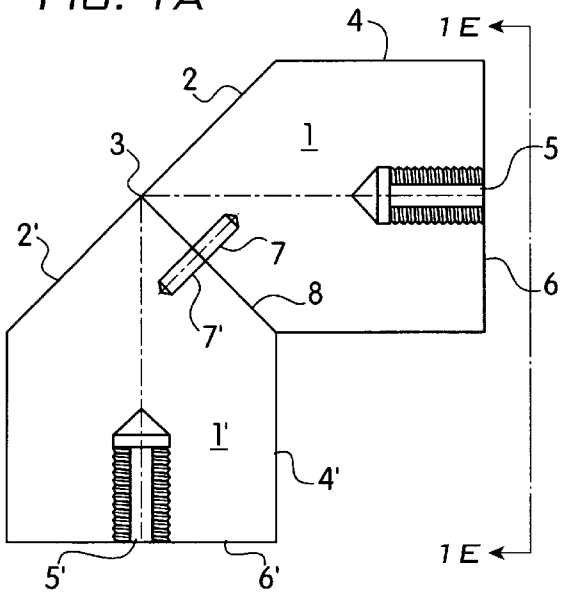
FIG. 1D
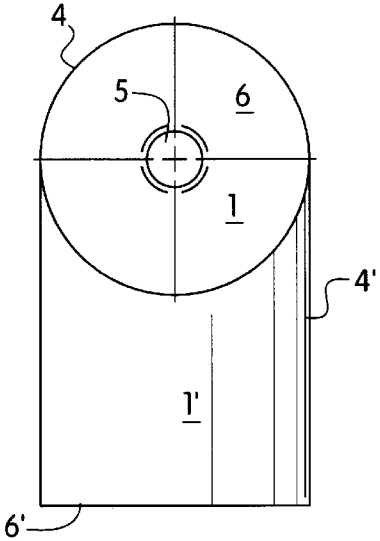
FIG. 1E

COAXIAL WAVEGUIDE CORNER

FIELD OF THE INVENTION

The present invention relates to the field of coaxial waveguide structures, and more particularly to structures for redirecting the axis of propagation of electromagnetic waves within a coaxial waveguide.

BACKGROUND OF THE INVENTION

Known coaxial waveguide elbows consist of a set of two symmetrical circular elements, affixed at right angles to form an elbow, with a flattened junction, as shown in FIGS. 1A–1E, which bridge a corner between two coaxial waveguide structures which also intersect at right angles. The electromagnetic waves are thus transduced by the circular elements between waves traveling at right angles.

The Electronics Industry Association has promulgated standard RS-225, which defines certain gas-insulated coaxial transmission lines, which have been extended by the industry to encompass a broad range of sizes, with standard impedances including 50Ω, 75Ω and 100Ω, and specialty structures ranging from 35Ω to 200Ω. Such coaxial transmission lines are available in a broad range of sizes, for example from ⅞ inch to 24 inch diameter, and used for frequencies from DC up to about 3 GHz. These gas-insulated transmission lines shall be referred to herein as "EIA-type" coaxial transmission lines.

It has been found, however, that the standard miter arrangement of circular elements for traversing corners is not entirely satisfactory. The elbow structure is very sensitive to variations, such as concentricity, thermal expansion, surface irregularities, and the like, making tuning difficult and resulting in variations in loss and reflections, e.g., VSWR. The structure also has a narrow bandwidth and considerable loss factor.

In these known structures, the circular elements have 45° double-bevels, forming a right angle between the circular elements, and having an ellipsoidal flat face having an eccentricity of 1.414 (√42) opposite the right angle junction.

An alternative known method of redirecting electromagnetic waves in a coaxial waveguide provides a coaxial structure with a gradual sweep bend, i.e. forming a section of a toroidal structure for the inner conductor. While this provides good electrical properties, it may require a significant distance to turn a right angle, and may be difficult to fabricate and install. Precise adjustments of such a structure are also difficult, due to the curved shape.

SUMMARY OF THE INVENTION

According to the invention, a segmented structure bridges the coaxial conductors in a corner structure of an EIA-type coaxial transmission line, having a generally rounded or ellipsoidal cross section. This segmented structure provides ease of manufacture and adjustment, better electrical properties, and compact installation.

According to a preferred embodiment of the present invention, a multi-element segmented, e.g., three section, structure is provided to form a functional a right angle junction. Two circular coaxial conductor elements, each having a flat surface normal to the cylindrical axis, enter a corner structure. Bridging these circular elements is an ellipsoid member, having single beveled ends, such that the outer edge of the bridging member corresponds to the outer edge of the circular conductor, thus minimizing a surface discontinuity between the respective elements. The preferred ellipsoid member has an eccentricity of 1.414 (√42), with 45° converging bevels at each end along the minor axis, resulting in a circular face at each end. These circular faces correspond to the rectangular cut ends of the circular elements.

It is therefore seen that in the preferred three element structure, a right angle elbow is formed, having symmetrical circular interfaces between each of the incoming center conductor elements, while the external cross section of the bridging member is ellipsoidal. The resulting structure according to the preferred embodiment has a cross section with curved surfaces throughout, and angles between conductor sections of 45°. It has been found that this structure is easier to tune, has a broader bandwidth, is more tolerant of environmental variations, has reduced VSWR, has improved impedance matching, and results in lower loss factors.

In order to provide a compact design, it is preferred that the corner structure fit within a "cube", with the circular conductors entering in the middle of two adjacent faces. The actual housing shape may be designed to provide optimal performance. Typically, the cube has side lengths approximately equal to the diameter of the outer conductor of the coaxial transmission line, and has dielectric wafers (formed, e.g., of PTFE or PEEK) which serve as supports for the inner conductors as they enter the cube.

The bridging structure according to the present invention has a broad bandwidth; however, it should be apparent that the operational frequency and characteristics may be altered in known manner, for example, by scaling the size and using conventional tuning techniques.

It is therefore an object of the invention to provide an EIA-type coaxial waveguide corner having improved electrical performance and compact dimensions.

It is a further object of the invention to provide a coaxial waveguide corner having multiple segments, with the mutual angles between individual elements of less than 90° and curved cross section external surfaces.

It is another object of the invention to provide a coaxial waveguide corner structure having an external waveguide forming a right angle corner and an internal waveguide corner structure providing a segmented bend.

These and other object will become apparent from a study of the embodiments disclosed herein. For a fill understanding of the present invention, reference should now be made to the following detailed description of the preferred embodiments of the invention as illustrated in the accompanying drawings.

BRIEF DESCRIPTION OF THE DRAWINGS

The preferred embodiments of the invention will be shown by of the Figures, in which:

FIGS. 1A through 1E show structures of a prior art corner conductor;

DETAILED DESCRIPTION OF THE PREFERRED EMBODIMENTS

Figure 2:
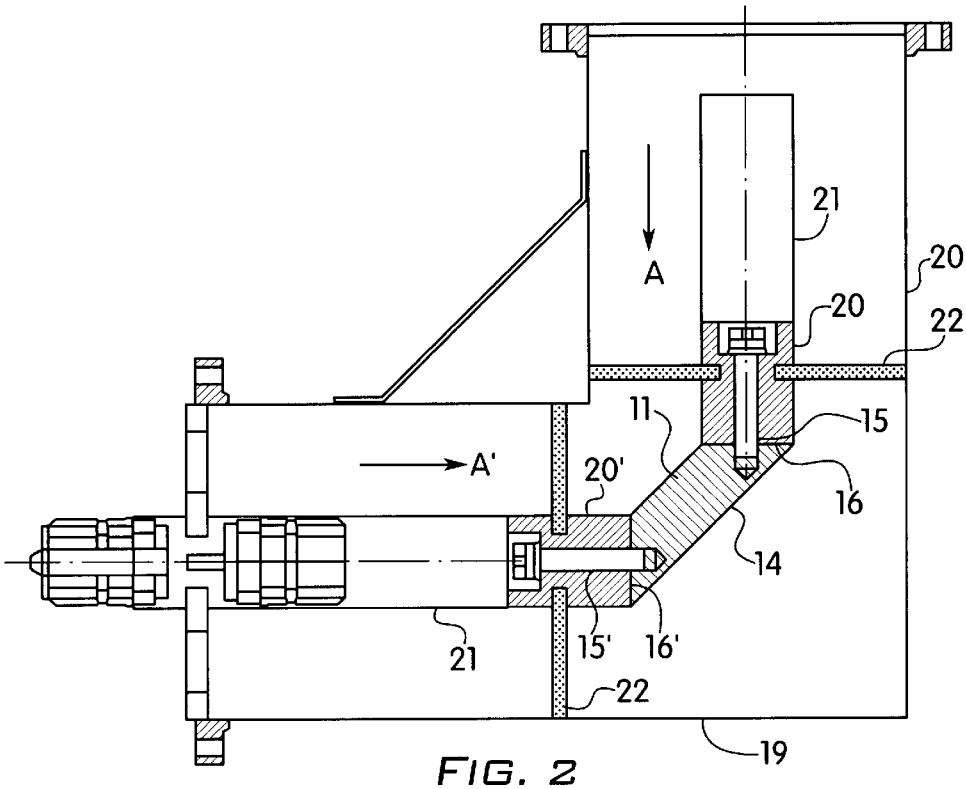
FIGS. 2 shows a multi-segmented corner conductor structure according to the present invention.

According to a known standard miter corner unit, the inner conductor of which is shown in FIGS. 1A through 1E, two double-beveled cylindrical members 1, 1' are joined at a common bevel face 8 by pins through holes 7, 7', to form a right angle conductor structure. FIG. 1A shows a cross section of a double-beveled cylindrical member 1, while FIG. 1C shows a side view showing a bevel face. FIG. 1B shows an end view, showing the end face 6 and end fitting 5 within a circular cross section. Each double-beveled cylindrical member 1, 1' has a cylindrical surface 4, 4', and an end fitting 5, 5' on an end face 6, 6' for connection to the central conductor of a coaxial transmission line. Typically, for a 75Ω, 6⅛" EIA-type (RS-225) coaxial elbow, these cylindrical members are 1.711 inches in diameter, with an inner diameter of the outer conductor of 5.982 inches, fitting within a 5½ inch cube, with the vertex of each cylindrical member nominally at the center of the corner cube. The relative diameters of cylindrical coaxial transmission lines for a given impedance are given by the formula impedance (ZΩ)=138* $\log_{10}$(outer ID/inner OD).

Figure 4A:
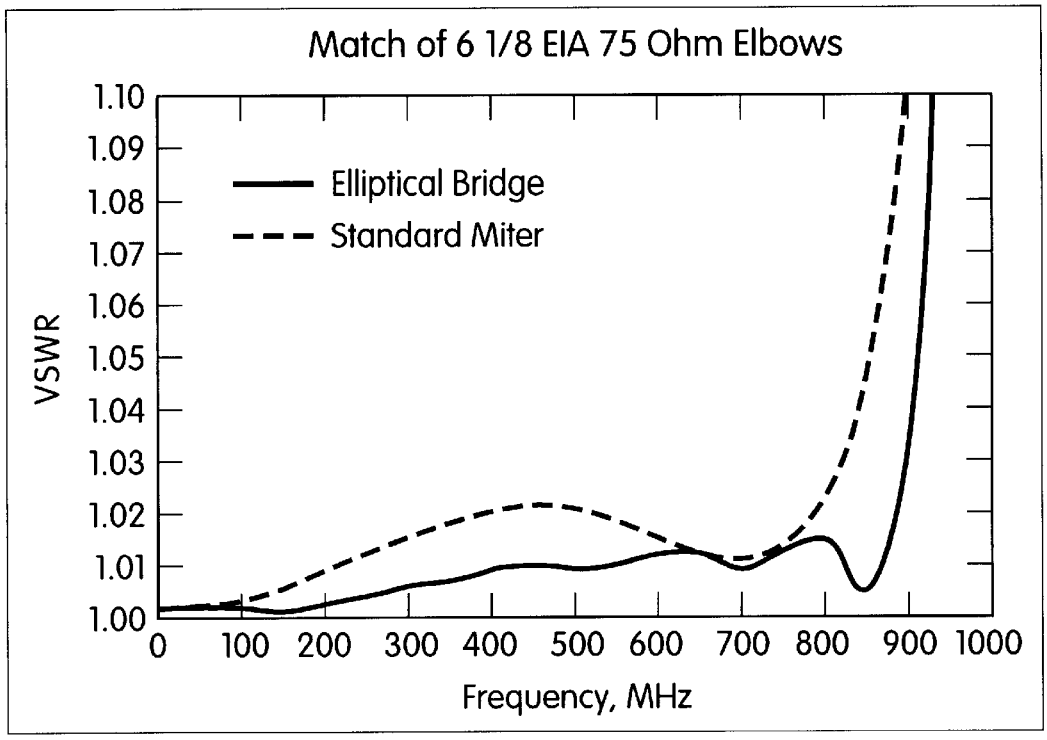
FIGS. 4A and 4B show comparisons of electrical performance of the prior art waveguide corner of FIGS. 1A through E and the waveguide corner according to the present invention of FIGS. 2 and 3A though 3C.
Figure 4B:
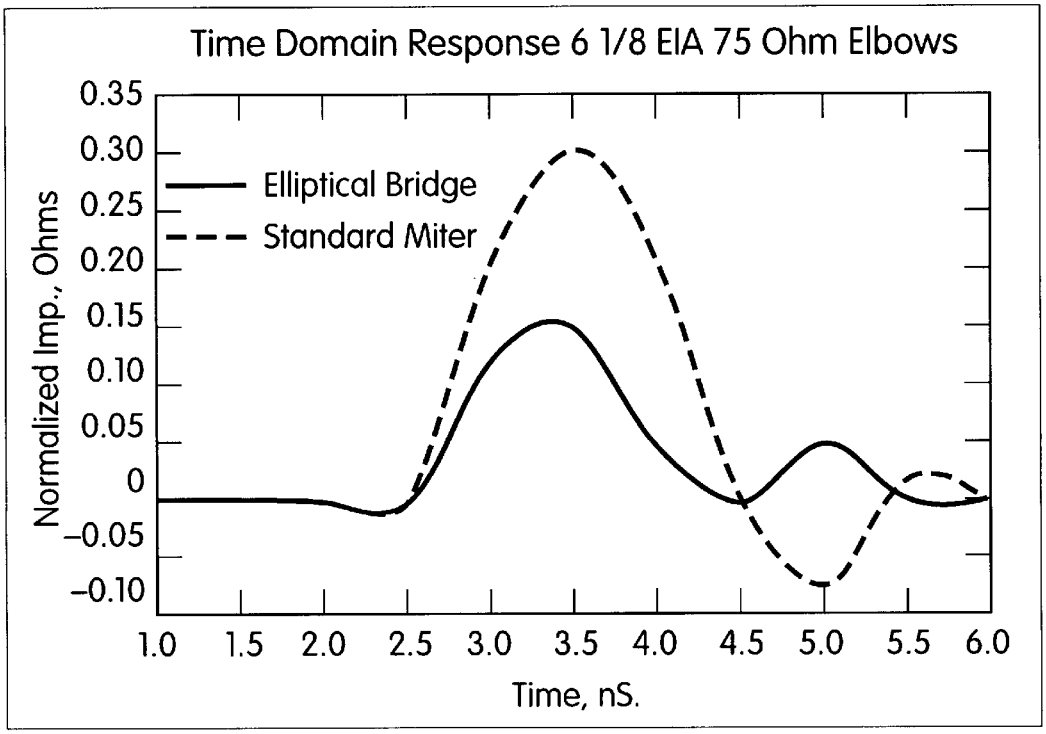

While the common bevel face 8 is hidden when two double-beveled cylindrical members 1, 1' are joined, by, for example silver solder, as shown in FIG. 1D, the two opposed bevel surfaces 2, 2' are presented externally. The exposed bevel faces of the standard miter are tuned in a unidirectional manner by shaving material, seeking to minimize the amplitude difference of the impedance mismatch peaks in the time domain response, as shown in FIG. 4B, and minimize the VSWR, as shown in FIG. 4A. FIG. 1E shows a side view of two joined double-beveled cylindrical members 1, 1'.

Figure 3B:
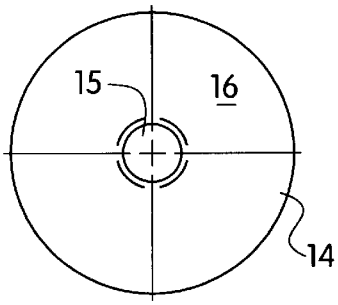
FIGS. 3A through 3C show detailed views of the bridging member of the corner conductor structure of FIG. 2.
Figure 3A:
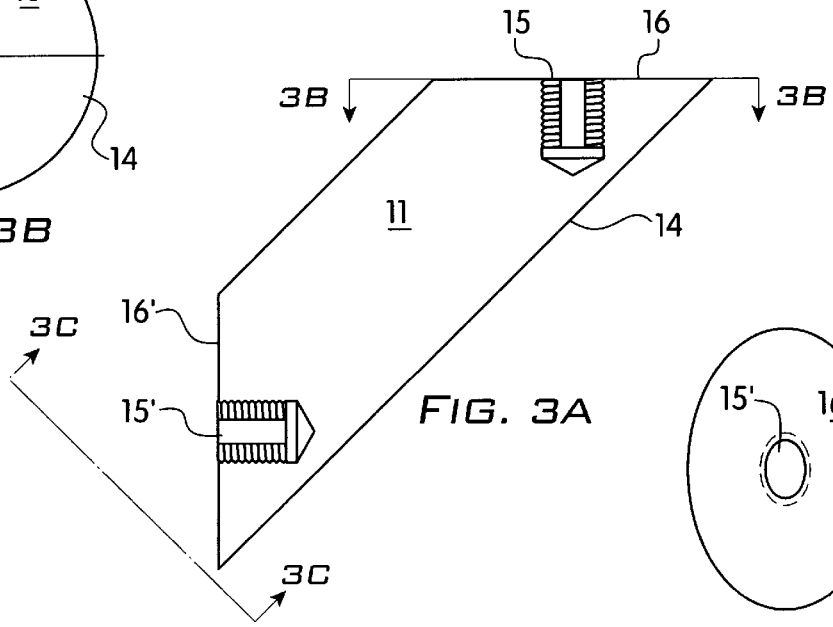
Figure 3C:
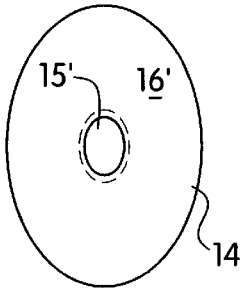

FIG. 2 shows a three element segmented structure forming a right angle junction in a coaxial waveguide system. This structure is, for example, about 8½ inches along each axis A, A', e.g., 5½ inches from the flange to the center of the corner cube, and 3 inches (about one half of the coaxial line diameter, 6⅛ inches) beyond the center. Two circular elements 20, 20' each have a flat surface 16, 16' normal to the cylindrical axis A, A' respectively, of the entering waveguide. Bridging these circular elements 20, 20' is an ellipsoid member 11, shown in more detail in FIGS. 3A through 3C, having single beveled ends 16, 16', as shown in FIG. 3A. The ellipsoid member 11 has an eccentricity of 1.414, as shown in FIG. 3C, with converging 45° bevels 16, 16' at each end inclined along the minor axis of the ellipsoid 14, resulting in a circular face at each end, as shown in FIG. 3B. The circular face has a diameter of, for example, 1.711 inches, with ellipsoid 14 cross section being 1.711 inches by 1.227 inches. The length of the ellipsoid member 11 at the closest convergence of the beveled faces is about 2.531 inches. These circular faces 16, 16' have a shape which corresponds with the end surfaces of the circular conductor elements 20, 20'.

The ellipsoid member 11 is preferably tuned by shortening or lengthening the ellipsoid member 11 and lengthening or shortening the cylindrical members, respectively. Alternately, with possible loss of efficiency, the structure may also be tuned by shaving the outer edge and/or inner edge of the ellipsoid member 11. In known manner, other portions of the system may also be tuned, for example the Teflon200 (or other PTFE or PEEK) supporting wafers 22.

As shown in FIG. 2, the ellipsoid member 11 acts as a bridge within a corner "cube" structure 19, between two EIA-type cylindrical coaxial waveguide structures. These waveguides are, for example, E.I.A. RS-225 6⅛ inch gas-spaced coaxial transmission lines, suitable for high power (1 kW or higher) use at DC to beyond UHF frequencies.

The elliptical bridge according to the present invention is applicable to the entire range of EIA-type coaxial transmission lines, for example from ⅞ inch to 24 inches in diameter, and for frequencies from DC up to about 3 GHz. Typically, for commercial broadcasts, the frequencies may range from about 100 to about 900 MHz, with power up to multiple megawatt levels, with appropriate size coaxial line. The inner conductors of the coaxial waveguides typically have a diameter between about 0.25 and about 5 inches, although the actual diameter is determined by the above formula, to result in a characteristic impedance, e.g., 50Ω, 75Ω or 100Ω.

In these types of installations, electrical performance of the transmission system is important for both power efficiency and performance. Typically, the voltage standing wave ratio (VSWR) is below 1.02, while the normalized impedance mismatch is held as low as possible, for example ±0.2Ω. Where the VSWR deviates substantially from 1, this is evidence of "moding", which is undesirable and is to be avoided at the operating point.

FIGS. 4A and 4B show comparative performance between the prior art waveguide standard miter shown in FIGS. 1A through 1E and the elliptical bridge according to the present invention shown in FIGS. 2 and 3A through C. FIG. 4A shows the VSWR vs. Frequency for known standard miter elbow unit and the elliptical bridge unit according to the present invention. Over the range of operation, the elliptical bridge unit, shown as a solid line, maintains VSWR less than 1.015 from DC up to about 870 MHz. The known standard miter unit, represented by the dashed line, has a VSWR above 1.02 for frequencies between about 400 and 500 MHz, and above about 785 MHz. Thus, the elliptical bridge unit according to the present invention has a significantly broader bandwidth for acceptable operation, and significantly lower VSWR at all frequencies except around 700 MHz and below 100 MHz. Because the electrical properties are typically below the acceptability threshold up to the maximum operating frequency, tuning of the device is less critical, or when performed leads o superior electrical performance. In practice, this would allow mass production of elliptical bridge units with less manual tuning efforts than prior designs. This may also allow use of the elliptical bridge unit at frequencies closer to the theoretical limit of the associated coaxial transmission line than prior art designs, especially where there are a number of bridges in the system.

FIG. 4B shows the time domain response of the normalized impedance of known standard miter elbow unit and the elliptical elbow unit according to the present invention, with respect to 6⅛ EIA (RS-225) 75 Ohm elbows. The elliptical elbow unit shows a mismatch of less than 0.15Ω max, with a small overshoot response. The known standard miter elbow unit shows a mismatch of about 0.30Ω max with an overshoot of about 0.08Ω. Thus, the elliptical elbow unit according to the present invention provides superior electrical response, with a wider bandwidth, better impedance matching and reduced reflections.

There has thus been shown and described novel waveguide corner structures and novel aspects of such waveguide corner structures which fulfill all the objects and advantages sought therefor. Many changes, modifications, variations, combinations, subcombinations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What I claim is:

1. In a coaxial transmission line waveguide corner structure comprising a pair of coaxial transmission lines having circular center conductors disposed along differing axes, the improvement comprising an ellipsoidal cross section bridging element disposed between the pair of circular conductors, having end surfaces corresponding to surfaces of the pair of circular conductors.

2. A coaxial transmission line waveguide corner structure, comprising a pair of circular cross section inner conductors within an outer conductor, each inner conductor having an axis and an end, said pair of conductors having non-coincident axes, and a conductive bridging element having two ends, each end mating with an end of one of said inner conductors, to provide a low loss and low reflection radio frequency electromagnetic wave path between said pair of conductors, said conductive bridging element having a non-circular outer profile matching an outer profile of said inner conductor at a junction thereof.

3. The coaxial transmission line waveguide corner structure according to claim 2, wherein the inner conductors have axes which intersect at an angle of 90°.

4. The coaxial transmission line waveguide corner structure according to claim 2, wherein the waveguide is of EIA-type and further comprises an insulating gas between the inner and outer conductor of the waveguide.

5. The coaxial transmission line waveguide corner structure according to claim 4, wherein the conductors of the waveguide form part of 6⅛ E.I.A. 75 Ohm coaxial transmission lines.

6. The coaxial transmission line waveguide corner structure according to claim 2, wherein the inner conductors of the waveguide have a diameter between about 0.25 and about 5 inches.

7. The coaxial transmission line waveguide corner structure according to claim 2, wherein the conductive bridging element has an ellipsoid cross section and convergent single beveled ends.

8. The coaxial transmission line waveguide corner structure according to claim 2, wherein the inner conductors are disposed on axes at right angles, said conductive bridging element having an ellipsoid cross section and two ends, each end having a convergent 45° bevel forming a circular face.

9. The coaxial transmission line waveguide corner structure according to claim 2, wherein each inner conductor has a circular face, the conductive bridging element having an ellipsoid cross section and two ends, each end having a convergent bevel forming a circular face, the angle of each bevel being one half the mutual angle of axes of the inner conductors.

10. The coaxial transmission line waveguide corner structure according to claim 2, wherein each inner conductor has a smooth outer surface and an end face, the conductive bridging element having a smooth outer surface and two end faces, each end face of the conductive bridging element mating with an end face of one of said conductors, to form an edge therebetween.

11. A method of bridging two coaxial transmission lines having circular cross section inner conductors with ends thereof and intersecting axes, comprising providing a non-circular cross section conductive bridge having a smooth outer surface, disposed between the ends of the pair of inner conductors, the conductive bridge having an end configuration mating with the ends of the pair of inner conductors.

12. The method according to claim 11, wherein the conductive bridge has an ellipsoidal cross section.

13. The method according to claim 11, wherein the inner conductors are disposed along intersecting axes at right angles, and the conductive bridge has convergent beveled ends each having a bevel angle of 45°.

14. The method according to claim 11, wherein the inner conductors are cylindrical and the conductive bridge is ellipsoidal having an eccentricity of 1.414, and wherein the inner conductors are disposed along intersecting axes at right angles, and the conductive bridge has convergent beveled ends each having a bevel angle of 45°.

15. The method according to claim 11, further comprising the step of mating each end of the conductive bridge with an end of an inner conductor, to provide a low loss and low reflection radio frequency electromagnetic wave path between said pair of inner conductors, the conductive bridge having an outer profile matching an outer profile of the conductor at a junction thereof.

16. The method according to claim 11, wherein the coaxial waveguide is of EIA-type, the conductors of the coaxial waveguide have a diameter between about 0.25 and about 5 inches, and the coaxial waveguide has a characteristic impedance between about 35Ω to about 200Ω.

17. A method of bridging two coaxial transmission lines having intersecting axes, each having an inner conductor with a cross section profile shape and an end, comprising providing a conductive bridge, having a cross section profile having a geometric shape different than a cross section profile shape of the inner conductors, disposed between the ends of the two conductors, the conductive bridge having, at an intersection with each conductor, an end surface which mates with an end surface of a respective conductor.

18. The method according to claim 17, wherein the conductive bridge is linear.

19. The method according to claim 17, wherein the cross section profile of the conductive bridge is ellipsoidal.

20. The method according to claim 17, wherein a respective end of an inner conductor and an end of the conductive bridge meet at a planar junction, a cross section face of each inner conductor corresponding to a cross section face of the conductive bridge.

21. The method according to claim 17, wherein each inner conductor has a smooth outer surface and an end face, the conductive bridge having a smooth outer surface and two end faces, each end face of the conductive bridge mating with an end face of one of said inner conductors, to form an edge therebetween.

* * * * *